United States Patent [19]

Buchman et al.

[11] Patent Number: 5,024,642

[45] Date of Patent: Jun. 18, 1991

[54] ROTARY DRAW TAPE BAG MAKING APPARATUS AND METHOD

[75] Inventors: James E. Buchman; Kenneth C. Jahnke, both of Appleton, Wis.

[73] Assignee: Presto Products, Incorporated, Appleton, Wis.

[21] Appl. No.: 280,027

[22] Filed: Dec. 5, 1988

[51] Int. Cl.[5] ..... B31B 23/60

[52] U.S. Cl. ..... 493/193; 493/205; 493/206; 493/208; 493/225

[58] Field of Search ..... 493/193–197, 493/200–202, 206, 208, 225, 928, 346, 381

[56] References Cited

U.S. PATENT DOCUMENTS

| | | | |
|---|---|---|---|
| 2,897,729 | 8/1959 | Ashton et al. . | |
| 2,973,697 | 3/1961 | Lerner . | |
| 3,029,853 | 4/1962 | Piazze . | |
| 3,058,403 | 10/1962 | Kugler . | |
| 3,147,168 | 9/1964 | Bateman | 493/205 |
| 3,196,757 | 7/1965 | Samways . | |
| 3,242,785 | 3/1966 | Schieven et al. . | |
| 3,322,600 | 5/1967 | Harrison et al. . | |
| 3,411,419 | 11/1968 | Becker et al. | 493/194 |
| 3,466,979 | 9/1969 | Sanders et al. . | |
| 3,512,456 | 5/1970 | Meyer . | |
| 3,603,216 | 9/1971 | Johnson . | |
| 3,622,421 | 11/1971 | Cook . | |
| 3,654,841 | 4/1972 | Davis Jr. . | |
| 3,656,415 | 4/1972 | Hook . | |
| 3,857,329 | 12/1974 | Lehmacher et al. . | |
| 3,859,895 | 1/1975 | White . | |
| 3,983,794 | 10/1976 | Buchner . | |
| 4,036,676 | 7/1977 | Pennington . | |
| 4,055,109 | 10/1977 | Kan . | |
| 4,072,076 | 2/1978 | Miles . | |
| 4,115,000 | 9/1978 | Mischo et al. . | |
| 4,273,549 | 6/1981 | Pezzana et al. . | |
| 4,308,087 | 12/1981 | Johnson . | |
| 4,380,446 | 4/1983 | Dickson et al. | 493/197 |
| 4,419,167 | 12/1983 | Hay, II et al. . | |
| 4,430,070 | 2/1984 | Ausnit . | |
| 4,557,712 | 12/1985 | Decker . | |
| 4,573,956 | 3/1986 | Johnson . | |
| 4,597,750 | 7/1986 | Boyd et al. . | |
| 4,624,654 | 11/1986 | Boyd et al. . | |
| 4,628,536 | 12/1986 | Herrington . | |
| 4,642,084 | 2/1987 | Gietman Jr. | 493/197 |
| 4,644,180 | 3/1987 | Herrington . | |
| 4,650,451 | 3/1987 | Herrington . | |
| 4,650,530 | 3/1987 | Mahoney et al. . | |
| 4,656,900 | 4/1987 | Herrington . | |
| 4,664,649 | 5/1987 | Johnson et al. . | |
| 4,717,372 | 1/1988 | Herrington . | |
| 4,732,065 | 3/1988 | Herrington . | |
| 4,746,391 | 5/1988 | Heyse et al. . | |
| 4,753,629 | 6/1988 | Powell et al. . | |

*Primary Examiner*—Frederick R. Schmidt
*Assistant Examiner*—Jack Lavinder
*Attorney, Agent, or Firm*—Willian, Brinks, Olds, Hofer, Gilson & Lione

[57] ABSTRACT

An apparatus is provided for continuously sealing a thermoplastic draw tape to a thermoplastic bag at a sealing section. The bag forms one of a plurality of bags formed on a continuous web of thermoplastic material. The bag includes a hem defining a channel wherein the draw tape is disposed. The section of the bag which includes the hem and the tape thus includes a plurality of layers of thermoplastic material. The apparatus comprises a conveyor for continuously moving the web; a first sealing station for forming a heat seal through at least two of the layers of the hem and tape, the seal being formed on a first side of the bag; and a second sealing station for forming a heat seal through the rest of the layers of the hem and tape at the sealing section on a second side of the bag. The first and second sealing stations form the seals while the web is continuously moved by the conveyor.

30 Claims, 4 Drawing Sheets

ROTARY DRAW TAPE BAG MAKING APPARATUS AND METHOD

BACKGROUND OF THE INVENTION

This invention relates generally to an apparatus and method for making draw tape thermoplastic bags and more particularly to an apparatus and method for making draw tape plastic bags wherein the draw tape is sealed or welded to the layers of thermal plastic of the hem of the bag and wherein the sealing process is performed as a continuous. as opposed to an intermittent process.

Plastic bags characterized by a draw tape which, when pulled. causes the mouth to constrict to substantially closed condition are generally referred to as draw tape plastic bags. Plastic bags of the type described are typically comprised of a bag body folded at the bottom to form front and rear sheets which are ordinarily sealed at the side edges. The upper edges of the front and rear sheets. located opposite the bottom fold, define the mouth of the bag. An upper margin at the bag mouth is typically folded inside the bag to form a hem which is ordinarily sealed to the bag body to form a channel for accommodating the draw tape. Pulling excessible portions of the draw tape typically causes the bag mouth to constrict and close as previously described.

Draw tape bags of the type described are often manufactured by automatic bag making machinery at a relatively rapid rate. This is typically accomplished by passing a web of plastic material through a number of folding sealing, and operating stations Typically the web is formed of a linear low density polyethylene material that originates as a tube of film.

As such. the above-described hem is typically made and sealed automatically by a machine at a hem sealing station. Typically the hem is formed by first slitting the tube of low density polyethylene material to form a web of material in C-folded condition. As used herein. the term C-folded condition refers to a length of material which has been folded over unto itself so as to form what may be subsequently identified as a front sheet and a rear sheet which are joined by the fold at the bottom, and are unjoined at the top so as to approximate a letter "C" in cross section. After the web has been cut into C-folded condition, the hem is usually formed at a station wherein the top edges of the C-folded web are folded towards the existing bottom fold in the C-folded web on the interior of the C-folded section, to form a hem at the mouth of the bag. After the hem is formed a tape typically made of a high density polyethylene thermoplastic material, is inserted into the hem. The hem is then sealed leaving the draw tape slidably disposed in the hem.

To improve the performance of the draw tape closure the draw tape is preferably sealed at the hem near each of the side edges of the bag. In this manner. when the draw tape is pulled out; the draw tape pulls the portion of the bag where it is sealed or welded to the hem toward the center of the bag, thereby closing the mouth of the bag. Heretofore the seal or weld of the draw tape to the bag has been ordinarily accomplished by briefly stopping the movement of the web so that a reciprocating jaw type heat sealer forms the seal through all of the layers of the hem and draw tape. This intermittent motion has been found necessary since the seal is typically formed through seven total layers of polyethylene material That is, the seal must be formed through four layers of low density polyethylene material corresponding to the hem (two layers for each side of the bag) and through two layers of high density polyethylene material corresponding to the draw tape (one layer for each side of the bag).

Though the intermittently formed seal or weld of the draw tape to the hem provided by such an operation has been acceptable, the time required to stop the movement of the web while the reciprocating jaw type heat sealer is aligned with the section where the weld is to be formed however brief it may be, is undesirable. Indeed almost any stoppage of the web as it proceeds through the manufacturing process may have concomitant drawbacks in efficiency speed, and economy. This intermittent sealing arrangement typically produces about 30 bags/min. It is desirable to increase this production rate, thereby increasing manufacturing economy and efficiency.

Therefore, in view of the above it is a primary object of the present invention to provide an apparatus and method for continuously forming a seal or weld between the draw tape and a predetermined section of the hem with continuous, non-intermittent type motion.

It is a further object of the present invention to provide a rotary type apparatus and method for forming a seal between the draw tape and a predetermined section of the hem.

It is still a further object of the present invention to provide an apparatus and method for improving the efficiency of sealing a draw tape to a predetermined section of the hem while still providing a secure seal through all of the layers of the hem and draw tape.

SUMMARY OF THE INVENTION

To achieve the foregoing and other objects and in accordance with the purposes of the present invention. the apparatus of the present invention provides a device for continuously sealing a thermoplastic draw tape to a thermoplastic bag. The seal is formed at a predetermined sealing section. The bag includes a hem defining a channel wherein the draw tape is disposed. The section of the bag which includes the hem and the tape thus includes a plurality of layers of thermoplastic material. The apparatus comprises conveyor means for continuously moving the web; first sealing means for forming a first heat seal through at least two of the layers of the hem and tape, the seal being formed from a first side of the bag; and second sealing means for forming a second heat seal through the rest of the layers of the hem and tape at the sealing section from a second side of the bag. The first and second sealing means form the seals as the web is continuously moved by the conveyor means.

In another aspect of the present invention, a method is provided for heat sealing a thermoplastic draw tape to a thermoplastic bag at a predetermined tape sealing section. The bag forms one of a plurality of bags formed on a continuous web of thermoplastic material. The bag includes a hem defining a channel wherein the draw tape disposed. The section of the bag which includes the hem and the tape thus includes a plurality of layers of thermoplastic material. The method includes the steps of continuously moving the web through a sealing station at a first sealing point in the sealing station, forming a heat seal through at least two of the layers of the hem and tape, the seal being formed from a first side of the bag at the sealing section; and at a sealing second point in the sealing station, forming a heat seal through the rest of the layers of the hem and tape at the sealing section from a second side of the bag as the web is continuously moved through the sealing station.

Thus. the apparatus and method of the present invention provide means for sealing a thermoplastic draw tape to a thermoplastic bag at the desired section of the bag in a continuous process The continuous process provides greater manufacturing speed, efficiency and economy over presently used intermittent methods.

Additional objects, advantages and novel features of the invention will be set forth in part in the description which follows and in part will become apparent to those skilled in the art upon examination of the following or may be learned by practice of the invention. The objects and advantages of the invention may be obtained by means of the combinations which are pointed out in the appended claims.

DETAILED DESCRIPTION OF THE PRESENTLY PREFERRED EMBODIMENTS

Figure 4:
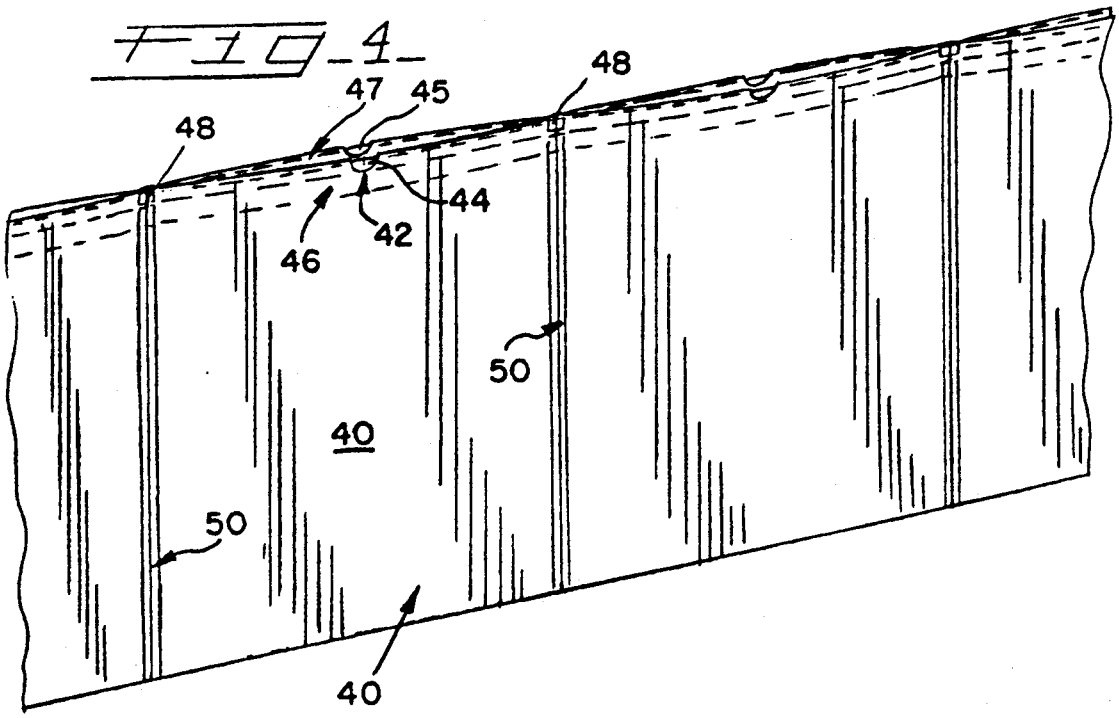
FIG. 4 schematically illustrates a portion of a web including a plurality a draw tape bags with the draw tape and the hem sealed or welded at the ends of the bag.
Figure 5:
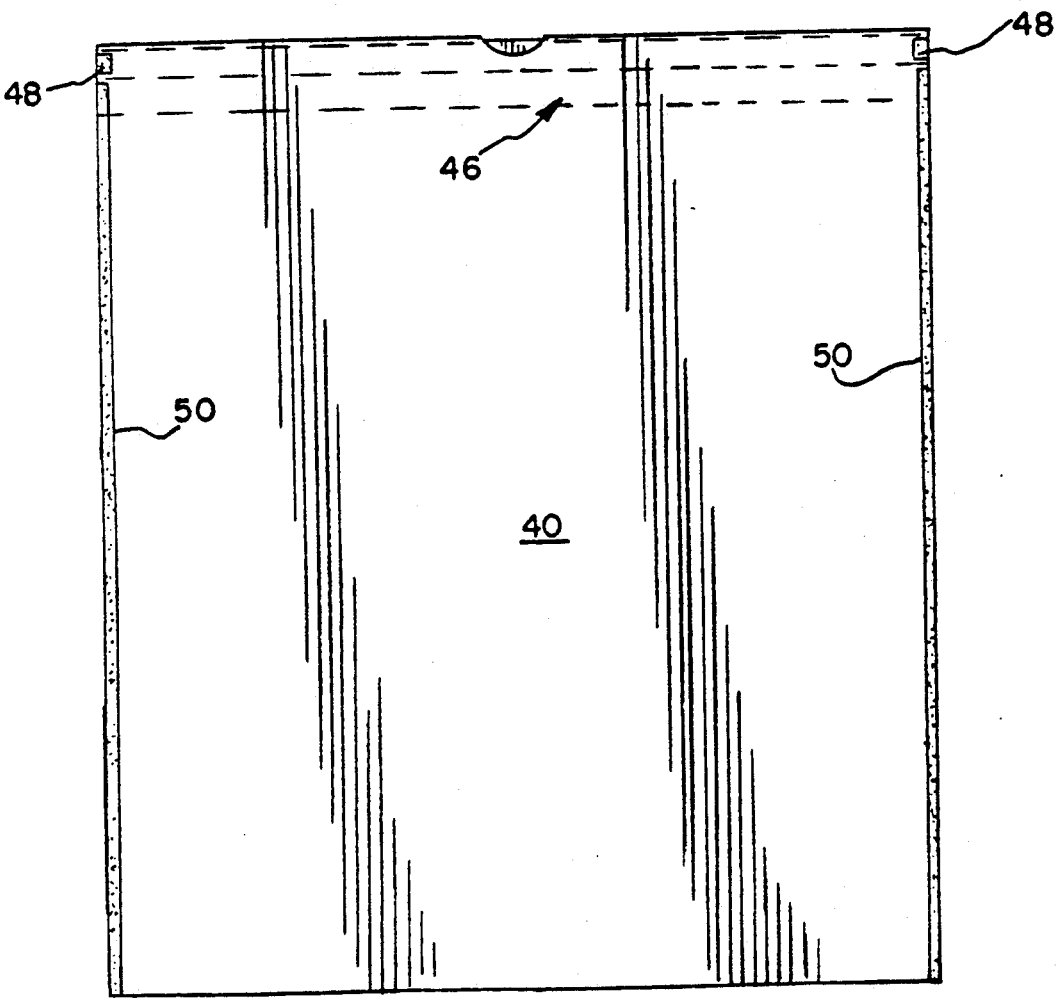
FIG. 5 illustrates one of the draw tape bags illustrated in FIG. 4.

Referring now to the drawings and specifically to FIGS. 4 and 5, a draw tape bag 40 forms one of a plurality of bags which are formed on a web of plastic film. The web which is originally in C-folded sections is sealed to form the side edges 50 of each individual bag. Each bag includes a draw tape 44. 45 which is inserted in a hem 46, 47. The draw tape 44. 45 is sealed to the hem 46 47 of the bag 40 at a predetermined sealing section 48 on each side of the bag 40. Preferably the sealing sections 48 are disposed near the corners of the bag 40 in order to pull the ends of the bag 40 toward the center of the bag when the tape 44, 45 is pulled out to thereby close the mouth of the bag 40. To assure that the bag 40 is symmetrically closed it is important that the seal 48 be formed through all of the layers of the hem 46, 47 and tape 44, 45. Thus, as described above the seal must be formed through two layers of low density polyethylene material for the hem 46 corresponding to the top side or face of the bag 40, one layer of high density polyethylene material corresponding to the draw tape 44 in the top face of the bag 40, two layers of low density polyethylene material for the layers of the hem 47 corresponding to the bottom side or face of the bag 40 and another layer of high density polyethylene material corresponding to the bottom side of the draw tape 45 in the bottom face of the bag 40. The hem 46, 47 also includes a center hole 42 on each side of the bag to provide access to the draw tape 44, 45.

Figure 1:
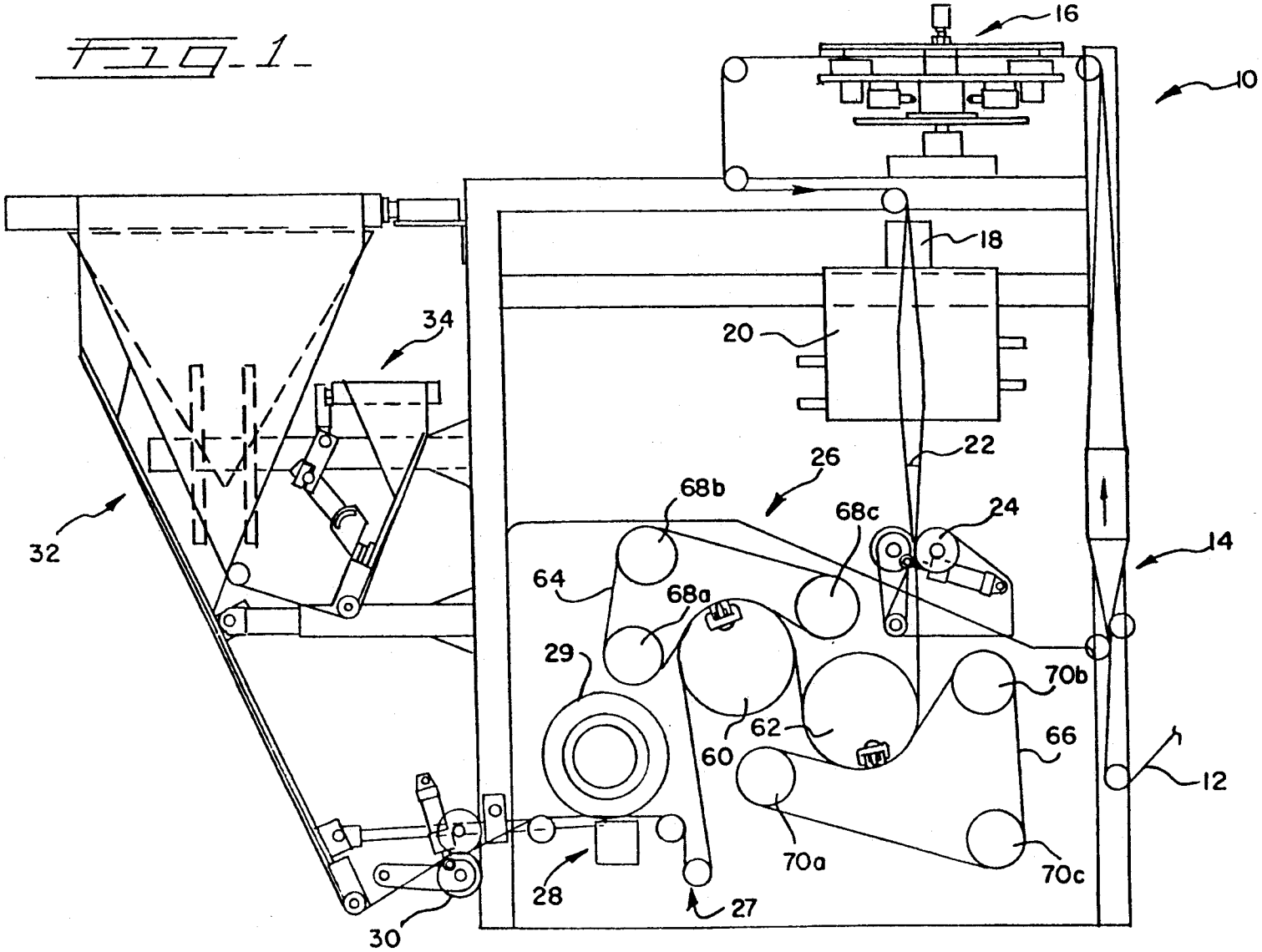
FIG. 1 is a schematic representation of a preferred embodiment of the apparatus of the present invention.

Referring now specifically to FIG. 1 a preferred embodiment of an apparatus for forming the hem and sealing the draw tape to the hem at a predetermined section is designated generally by preference numeral 10. Such a machine typically includes an unwinding station which may comprise a plurality of rollers for unwinding and conveying a web 12 of plastic material from a supply station (not shown). The source or supply station of the web of plastic material may be an extruder continuously producing a tube of blown film which is then shaped into the desired form, a master roll of C-folded film, etc. The web 12 is typically first passed to a dancer station which comprises a series of rollers to compensate for the variations in speed that may occur as the web 12 is moved through other stations comprising the machine 10.

If the web 12 is formed from an extruder which produces a tube of film. the web 12 is first formed into two flat overlapping layers and then passed through a hem cutting and folding station 14. At the hem cutting and folding station 14 the flat web 12 is cut along one of its longitudinal edges to thereby form the C-folded configuration. The top edges of the C-folded web 12 may then be folded toward the existing bottom fold in the C-folded web 12, preferably interiorly of what would ultimately be a completed bag 40. The details of a preferred embodiment of the hem cutting and folding station 14 are described in more detail below. After a hem has been formed in the web 12 which is now in C-folded condition, this portion of the web 12 is conveyed downstream (in the direction of the arrows) to a hole punching station 16, which forms the center hole.

Preferably the hole punching station 16 includes a servo-motor driven hole punch system which intermittently punches the holes in the center of the hem 44, 45 as the web 12 is passed through the station 16.

The web 12 may then be passed to a tape application station 18 containing a spool of plastic material which is to be used as the draw tape 44. 45 for constricting the opening of the completed bags 40 in the manner previously explained. The material comprising the draw tape 44, 45 is aligned with one or both unjoined top edges of the C-folded web 12, and conveyed adjacent thereto at substantially the same rate of speed.

The C-folded web 12 and the adjacent draw tape 44 45 are then typically conveyed to a hem sealing station 20. Although the hem sealing station 20 is preferably of a continuous moving type the specific design of the hem sealing station does not form part of the present invention. At the hem sealing station 20, the hem 46, 47 is sealed to the web 12 thereby defining the channel wherein the draw tape 44 45 is slidably enclosed After leaving the hem sealing station 20, the web 12 is conveyed through a cooling plate 22 which cools the seal which has been formed in the hem 46, 47. After passing through the cooling plate 22 a pair of nip rollers 24 guide the web to the continuous draw tape sealing station 26 which is described in greater detail below. At the continuous draw tape sealing station 26 the seal or weld 48 which seals the layers of the draw tape 44, 45 and the hem 46, 47 is formed near the side edges of the bag 40.

As described in greater detail below. preferably. the draw tape sealing station 26 also includes means for forming the seals 50 on the side edges of the bag 40 to thereby define individual bags on the web 12.

Upon leaving the draw tape sealing station 26 the web 12 is conveyed to a perforating station designated in FIG. 1 by reference numeral 28. The perforating station 28 preferably includes a blade or fly knife (not shown) disposed on a rotating drum 29. The fly knife perforates the web 12 along the side edges of the bag 40 so that the bags may be separated. The perforating station 28 typically includes a pair of rollers 27 which adjust the skirt of the web 12 before entering the station which includes the roller 29 and the perforating blade. From the bag perforating station 28 the web 12 passes through a pair of nip rollers 30. After leaving the nip rollers 30 the bags 40 formed in the web 12 are conveyed to a folding station 32 where the completed bags 40 may be folded as desired. The web 12 is then conveyed to a winding station 34 where the completed, folded bags are wound onto a roll.

Figure 6:
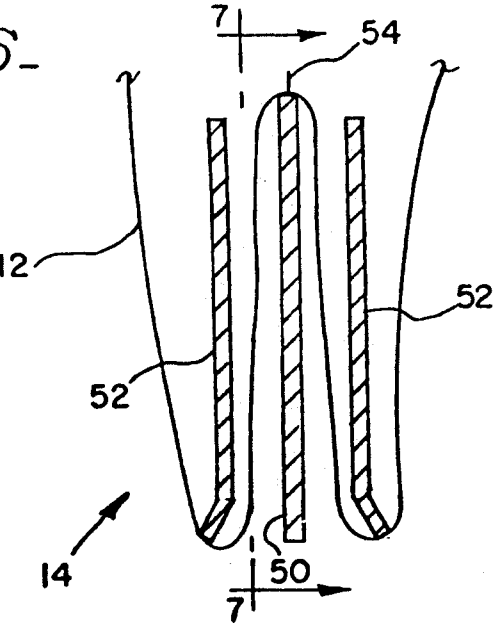
FIG. 6 shows a preferred embodiment of the hem cutter and folder of the present invention.
Figure 7:
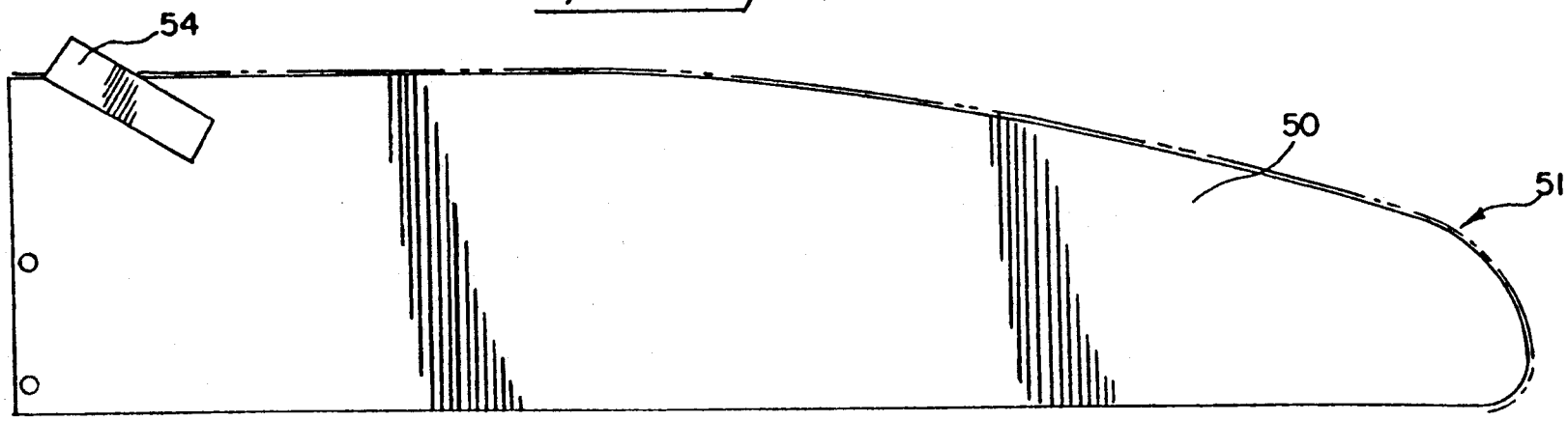
FIG. 7 is a sectional view through lines 7—7 of FIG. 6 illustrating a preferred embodiment of the plate and cutter of the hem folder and cutter illustrated in FIG. 6.

Now referring specifically to FIGS. 6 and 7, the hem cutting and folding station 14 is described in greater detail. In the preferred embodiment of the hem folding and cutting station 14 the web 12 is cut and folded to form the hems 46, 47 in a single step at the station 14. This arrangement reduces the number of steps to cut and fold the hem 46, 47 in the process for forming the bags 40 from the web 12.

The hem cutting and folding station 14 includes a center plate 50 and a pair of side plates 52. The center plate 50 includes a blade 54 for cutting the web 12 as the web is continuously moved through the cutting and folding station 14. The blade 54 is preferably detachably secured to the center plate 50 by conventional means to facilitate replacement of the blade 54. The web 12 is wound through the side plates 52 and center plate 50 of the cutting and folding station 14 as illustrated in FIG. 5. The center plate 50 includes a curved front portion identified by reference numeral 51, to allow the web 20 to easily slide over the plate 50. The blade 54 is used to sever or cut the web 12 from the tubular section into the C-folded section.

As can be visualized from FIG. 6, as the blade 54 cuts the tubular web, the plates 52 form the hems 46, 47 on each of the faces of the web 12 (now in C-folded section). Therefore, the hem folding and cutting station 14 performs both the functions of cutting the web and folding the hem in one continuous process at a single station.

Figure 2:
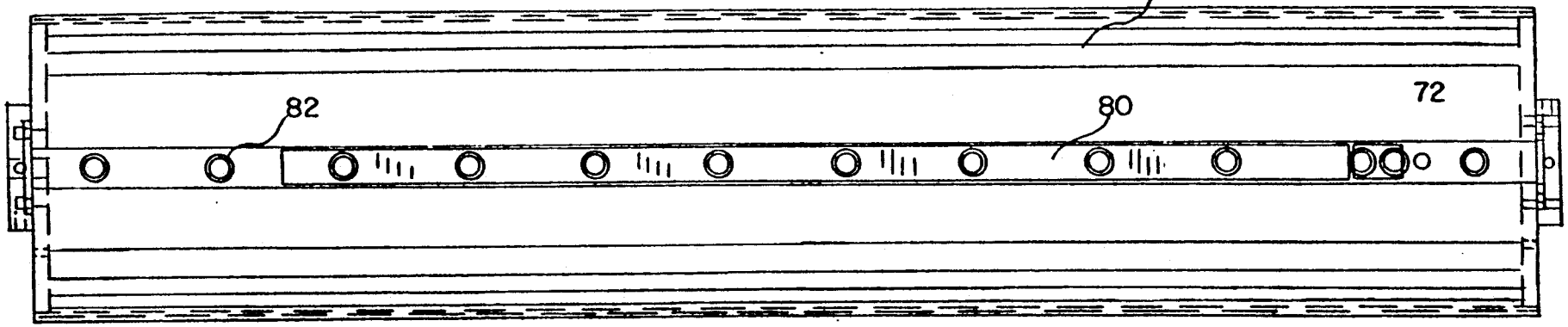
FIG. 2 is a side elevational view of one of the heat sealing drums illustrated in FIG. 1, which seal the draw tape to the bag.
Figure 3:
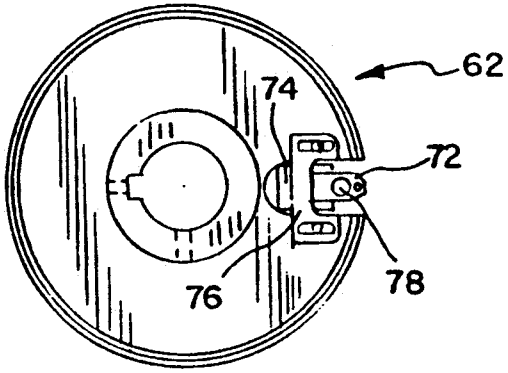
FIG. 3 is a front view of the drum of FIG. 2.

Referring now to FIGS. 1, 5 and 6 a more detailed description of the preferred embodiment of the draw tape sealing station 26 is given. Drums 60 and 62 in the draw tape sealing station 26 are similar and therefore a preferred embodiment of only one of the drums 60 62 illustrated in FIGS. 2 and 3 is described. It will be readily recognized by those skilled in the art that the other of the drums has a similar construction with respect to the draw tape sealing function (as described below only one of the drums 60, 62 includes a sealing bar for forming the seals 50 at the edges of the bags 40).

As best illustrated in FIG. 1 the preferred embodiment of the draw tape sealing station 26 includes first and second sealing means to form the seal or weld at the predetermined section (preferably near the side ends of the bag) between the layers of the hem 46 and 47 and the draw tape 44 and 45. The first sealing means forms a seal or weld between at least two of the layers of the hem 46 and 47 and the draw tape 44 and 45 from a first side or face of the web 12. Preferably the first sealing means forms a seal through approximately 70% of the layer of the hem 46 and 47 and draw tape 44 and 45 from the first side or face of the web 12. The second sealing means is located downstream from the first sealing means. The second sealing means seals or welds the rest of layers of the hem 46 and 47 and the draw tape 44 and 45 which were not sealed by the first draw tape sealing means. The second sealing means forms the seal from the second face of the web 12.

The first draw tape sealing means preferably comprises a first rotatably mounted sealing drum 62 including a first electrically heated draw tape sealing element 72 and means for urging the web 12 against the sealing element 72 as the web 12 is passed over the sealing drum 62. Preferably the urging means comprises an endless TEFLON coated DACRON sealing blanket 66 which is entrained on a plurality of rollers 70*a*, 70*b*, and 70*c*. The rollers 70–70*c* are arranged such that press the sealing blanket 66 is firmly pressed against the sealing drum 62 and thus against the sealing element 72. It will be recognized by those skilled in the art that other urging arrangements are possible without deviating from the scope of the invention.

Referring now specifically to FIGS. 2 and 3, the sealing drum 62 preferably comprises a drum 61 made of any suitable material such as aluminum. The drum 61 includes a groove which houses the heating element assembly. The heating element assembly preferably includes an electrically heated sealing element 72, including an electrical slip ring assembly, for sealing the draw tape 44, 45 to the hem 46. 47 at the predetermined section 48. The sealing element 72, hereinafter referred to as a sealing bar includes an aperture which houses an electrical heating element such as a CALROD heater. The sealing bar may be made of any suitable material such as aluminum.

Preferably. the sealing bar 72 is adjustably mounted to the sealing drum 61. In the preferred embodiment the sealing bar 72 is mounted to a back-up bar 74 by any suitable means such as by bolts (indicated by reference numeral 82). The back-up bar 74 is in turn attached to an adjustably mounted brace 76 which permits radial adjustment of the sealing bar 72. In this manner the radial distance that the sealing bar 72 protrudes from the outer surface of the sealing drum 61 may be selectively adjusted depending on the particular application. In an exemplary embodiment the sealing bar protrudes 3/16" from the outer surface of drum 61.

In a preferred embodiment the sealing drum 62 also includes a longer sealing bar 80 which is used to form the seals 50 on the side edges of the bag 40. In this manner both the seal 48 for the draw tape to the hem and the seal 50 for the side edge can be formed in one continuous process by a single sealing drum. Since the edge sealing bar 80 only seals through two layers of low density polyethylene material as opposed to the four layers of low density polyethylene material and the two layers of high density polyethylene material that the draw tape sealing bar 72 seals the temperature of the edge sealing bar 80 is maintained lower than the temperature of the draw tape sealing bar 72. For example. the temperature of the edge sealing bar 80 may be maintained at a temperature of approximately 300° F. and the temperature of the draw tape sealing bar 72 (on both drums 60 and 62) may be maintained at approximately 550° F. Further, since the edge sealing bar 80 only seals through two layers, only one edged sealing bar 80 is necessary. Thus, the edge sealing bar 80 may be disposed on either one of drums 60 and 62. but is preferably disposed on the first sealing drum 62.

It will be recognized by those skilled in the art that the diameter of the sealing drums 60 and 62 will vary depending on the size of the bag which is to be manufactured. Each of the drums 60 and 62 has a diameter such that the sealing bars 72 and 80 engage the web 12 in the contacting area once per revolution. In an exemplary embodiment each of the drums 60, 62 has an outside diameter of approximately 30 inches. Further the bars 72 and 80 are disposed on the drum 61 such that they align with the top and bottom borders of the bag and the sealing section of the hem.

The drums 60, 62 may be driven by any suitable driving means such as D.C. electrical motors. The drums 60 and 62 are synchronized or timed such that the sealing bars 72 on each drum engage the web 12 at the appropriate sealing section 48. The drive for the fly knife drum 29 may be timed off one of the drums 60 and 62 such that the bag is perforated at the appropriate section of the web 12. The rollers **68*a*–68*c* and 70*a*–70*c* are preferably arranged to rotate freely such that the drive for the drums 60 and 62 also drives the sealing blankets 64 and 66**. respectively.

Since prior art methods sealed all of the layer of the hem and draw tape in a single step it was necessary to form the seal in intermittent fashion to provide an acceptable seal. In contrast, the present invention forms the seal, first by partially sealing the layers from one face or side of the web and then by sealing the balance of the layers from the other side of the web. In this manner the seal can be formed in two continuous steps as opposed to the one intermittent step of the prior art designs. As discussed above with prior art designs approximately 30 bags/min can be manufactured. Presently with use of the present invention approximately 70 bags/min. can be manufactured and its is envisioned that higher rates are possible The foregoing description of the preferred embodiments of the present invention have been presented for purposes of illustration and description. They are not intended to be exhaustive or to limit the invention to the precise forms disclosed and obviously many modifications and variations are possible in light of the above teachings. The embodiments were chosen and described in order to best explain the principals of the invention and its practical applications to thereby enable others skilled in the art to best utilize the invention in various embodiments and with various modifications as are suited to the particular use contemplated. It is intended that the scope of the invention be defined by the following claims, including all equivalents.

We claim:

1. An apparatus for sealing a thermoplastic draw tape to a thermoplastic draw tape bag at a discrete draw tape sealing section at a lateral side of the bag, the bag including a first and second face, a hem defining a channel and the draw tape disposed in the channel, thereby defining at least four layers in the section where the tape is disposed in the hem, the apparatus comprising:

a first rotatably mounted drum including a first sealing element fixedly attached thereto, the first sealing element configured to form the discrete draw tape sealing section and disposed such that upon rotation of the first drum the first sealing element engages the hem at the draw tape sealing section on a first face of the bag;

a second rotatably mounted drum including a second sealing element fixedly attached thereto, the second sealing element disposed such that upon rotation of the second drum the second sealing element engages the hem at the sealing section on a second face of the bag;

rotating means for rotating the first and second drums;

first urging means for urging the first sealing element into contact with the bag at the draw tape sealing section, the first drum and first urging means defining a first sealing station;

second urging means for urging the second sealing element into contact with the bag at the draw tape sealing section, the second drum and second urging means defining a second sealing station;

conveyor means for continuously moving the bag through the first and second stations; and the second rotatably mounted drum being disposed downstream of the first rotatably mounted drum relative to the direction of movement of the bag;

wherein a portion of the at least four layers in the draw tape sealing section are sealed at the first sealing station from a first side of the bag and the rest of the at least four layers in the draw tape sealing section are sealed at the second sealing station from the second opposite side of the bag.

2. The apparatus of claim 1 wherein the bag is arranged to define a first side edge and a second side edge and wherein the rotating means is adapted to synchronously rotate the first and second drums such that a first sealing section is formed at the first side edge and a second sealing section is formed at the second side edge of the bag.

3. The apparatus of claim 1 wherein the first and second sealing elements comprise a first sealing bar and a second sealing bar, respectively, and means for heating the sealing bars.

4. The apparatus of claim 3 wherein the means for heating the first and second sealing bars comprises first and second electric heating elements, respectively.

5. The apparatus of claim 1 wherein the first and second urging means comprise a first and a second endless sealing blanket, respectively. the first and second sealing blankets each entrained on rollers.

6. The apparatus of claim 1 wherein the bag composes one of a plurality of bags formed on a continuous web of thermoplastic material and wherein the conveyor means comprises means for continuously moving the web through the first and second sealing stations.

7. The apparatus of claim 6 wherein the first drum further includes sealing bar means, adjacent one of the first and second sealing elements for sealing the two faces of the web to form a seal defining an edge of the bag.

8. The apparatus of claim 7 wherein the sealing bar means comprises an electrically heated sealing bar.

9. The apparatus of claim 1 wherein the first sealing element seals approximately 70% of the layers of the hem and draw tape from the first face of the bag and the second sealing element seals the rest of the layers from the second face of the bag.

10. An apparatus for sealing a thermoplastic draw tape to a thermoplastic draw tape bag at a discrete draw tape sealing section at a lateral side of the bag, wherein the bag composes one of a plurality of bags formed on a continuous web of thermoplastic material, the bag including a hem defining a channel and the draw tape disposed in the channel, thereby defining at least four layers in the section where the tape is disposed in the hem, the apparatus comprising:

a first rotatably mounted drum including a first sealing element fixedly attached thereto, the first sealing element configured to form the discrete draw tape sealing section and disposed such that upon rotation of the first drum the first sealing element engages the hem at the draw tape sealing section from a first face of the bag;

a second rotatably mounted drum including a second sealing element fixedly attached thereto, the second sealing element configured to form the discrete draw tape sealing section and disposed such that upon rotation fot he second drum the second sealing element engages the hem at the draw tape sealing section from a second face of the bag;

rotating means for rotating the first and second drums;

first urging means for urging the first sealing element into contact with the web at the draw tape sealing section, the first drum and first urging means defining a first sealing station;

second urging means for urging the second sealing element into contact with the web at the draw tape sealing section, the second drum and second urging means defining a second sealing station; and conveyor means for continuously moving the web through the first and second sealing stations; and the second rotatably mounted drum being disposed downstream of the first rotatably mounted drum relative to the direction of movement of the web;

wherein a portion of the at least four layers in the draw tape sealing section are sealed at the first sealing station from a first side of the web and the rest of the at least four layers in the draw tape sealing section are sealed at the second sealing station from the second opposite side of the web.

11. The apparatus of claim 10 wherein the bag includes a first side edge and a second side edge and wherein the rotating means is adapted to synchronously rotate the first and second drums such that a first sealing section is formed near the first side edge and a second sealing section is formed near the second side edge of the bag.

12. The apparatus of claim 10 wherein the first and second sealing elements comprise a first and a second sealing bar respectively and means for heating the sealing bars.

13. The apparatus of claim 12 wherein the means for heating the first and second sealing bars comprise first and second electric heating elements respectively.

14. The apparatus of claim 10 wherein the first and second urging means comprise a first and a second endless sealing blanket respectively. the first and second sealing blankets each entrained on rollers.

15. The apparatus of claim 10 wherein the first drum further includes bag side edge sealing means, adjacent one of the first and second sealing elements for sealing the two faces of the web to form a seal defining an edge of the bag.

16. The apparatus of claim 15 wherein the bag side edge sealing means comprises an electrically heated sealing bar.

17. The apparatus of claim 10 wherein the first sealing element seals approximately 70% of the layers of the hem and draw tape from the first face of the bag and the second sealing element seals the rest of the layers from the second face of the bag.

18. An apparatus for manufacturing a thermoplastic draw tape bag from a continuous web of thermoplastic material including a sealed hem defining a channel and a thermoplastic draw tape disposed in the channel thereby defining at least four layers in the section where the tape is disposed in the hem, the apparatus comprising:

a first rotatably mounted drum including a first sealing element fixedly attached thereto, the first sealing element disposed such that upon rotation of the first drum, the first sealing element engages the hem at a draw tape sealing section on a first face of the web, the first sealing element configured to form a discrete seal at the draw tape sealing section;

a second rotatably mounted drum including a second sealing element fixedly attached thereto, the second sealing element configured to form a discrete seal at the draw tape sealing section and disposed such that upon rotation of the second drum the second sealing element engages the hem at the sealing draw tape section on a second face of the bag;

rotating means for rotating the first and second drums;

first urging means for urging the first sealing element into contact with the web at the draw tape sealing section, the first drum and first urging means defining a first sealing station;

second urging means for urging the second sealing element into contact with the web at the draw tape sealing section, the second drum and second urging means defining a second sealing station;

bag edge sealing means for heat sealing the two faces of the web to form a seal defining an edge of the bag, the bag edge sealing means disposed on one of the first and second drums;

conveyor means for continuously moving the web through the first and second sealing stations; and the second rotatably mounted drum being disposed downstream of the first rotatably mounted drum relative to the direction that the web is moved;

wherein a portion of the at least four layers in the draw tape sealing section are sealed at the first sealing station from a first side of the web and the rest of the at least four layers in the draw tape sealing section are sealed at the second sealing station from the second opposite side of the web.

19. The apparatus of claim 18 wherein the rotating means is adapted to synchronously rotate the first and second drums such that a first sealing section is formed near a first side edge and a second sealing section is formed near a second side edge of the bag.

20. The apparatus of claim 18 wherein the first and second sealing elements comprise a first sealing bar and a second sealing bar, respectively, and means for heating the sealing bars.

21. The apparatus of claim 20 wherein the means for heating the first and second sealing bars comprise first and second electric heating elements. respectively, and wherein the bag side edge sealing means comprises an electrically heated sealing bar.

22. The apparatus of claim 18 wherein the first and second urging means comprise a first and a second endless sealing blanket. respectively. the first and second sealing blankets each entrained on rollers.

23. An apparatus for sealing a thermoplastic draw tape to a thermoplastic draw tape bag at a discrete draw tape sealing section at a lateral side of the bag, wherein the bag composes one of a plurality of bags formed on a continuous web of thermoplastic material, the bag including a first and a second face, a hem defining a channel in each face and the draw tape disposed in each of the channels, thereby defining at least four layers in the section where the tape is disposed in the hem, the apparatus comprising:

conveyor means for continuously moving the web;

first sealing means for forming a heat seal through a portion of the at least four layers of the hem and tape, the seal being formed from a first face of the bag at the draw tape sealing section as the web is continuously moved by the conveyor means; and second sealing means for forming a heat seal through the rest of the at least four layers of the hem and tape at the draw tape sealing section from a second opposite face of the bag as the web is continuously moved by the conveyor means, the second sealing means being disposed downstream of the first sealing means relative to the direction that the web is conveyed.

24. The apparatus of claim 23 wherein:

the first sealing means comprises a first rotatably mounted drum including a first sealing element fixedly attached thereto, the first sealing element disposed such that upon rotation of the first drum the first sealing element engages the hem at the draw tape sealing section on a first face of the bag, and first urging means for urging the first sealing element into contact with the web at the draw tape sealing section, the first drum and first urging means defining a first sealing station;

the second sealing means comprises a second rotatably mounted drum including a second sealing element fixedly attached thereto, the second sealing element disposed such that upon rotation of the second drum the second sealing element engages the hem at the draw tape sealing section on a second face of the bag, and second urging means for urging the second sealing element into contact with the web at the draw tape sealing section, the second drum and second urging means defining a second sealing station; and rotating means for rotating the first and second drums.

25. The apparatus of claim 24 wherein the rotating means is adapted to synchronously rotate the first and second drums such that a first sealing section is formed near a first side edge and a second sealing section is formed near a second side edge of the bag.

26. The apparatus of claim 25 wherein the first and second urging means comprise a first and a second endless sealing blanket, respectively, the first and second sealing blankets each entrained on rollers.

27. The apparatus of claim 24 wherein the first and second sealing elements comprise a first sealing bar and a second sealing bar, respectively, and means for heating the first and second sealing bars.

28. A method of sealing a thermoplastic draw tape to a thermoplastic bag at a discrete draw tape sealing section, wherein the bag composes one of a plurality of bags formed on a continuous web of thermoplastic material, the bag having a first and a second face and including a hem defining a channel and the draw tape disposed in the channel, thereby defining at least four layers in the section where the tape is disposed in the hem, the method comprising the steps of:

continuously moving the web through a sealing station;

at a first sealing point in the sealing station, forming a heat seal through a portion of the at least four layers of the hem and tape, the seal being formed from the first face of the bag at the sealing section as the web is continuously moved through the sealing station; and at a second sealing point in the sealing station disposed downstream of the first sealing point relative to the direction that the web is moved, forming a heat seal through the rest of the at least four layers of the hem and tape at the sealing section from the second opposite face of the bag as the web is continuously moved through the sealing station.

29. The method of claim 28 wherein at each of the sealing points in the sealing station, the step of forming a seal through the respective layers of the hem and tape comprises:

conveying the web over a rotatable drum including a sealing element such that the draw tape sealing section is aligned with the sealing element as the web passes through the sealing point;

urging the web against the sealing element at the draw tape sealing section as the web passes through the sealing point; and applying sufficient heat to the sealing element to seal the respective layers to be sealed at each respective sealing point in the sealing station.

30. The method of claim 28 wherein the step of heat sealing at least two of the layers of the bag and tape comprises sealing approximately 70% of the layers of the bag and tape.

* * * * *